US007988842B2

(12) United States Patent
Tachibana et al.

(10) Patent No.: US 7,988,842 B2
(45) Date of Patent: Aug. 2, 2011

(54) CONTINUOUS COPPER ELECTROPLATING METHOD

(75) Inventors: Shinji Tachibana, Hirakata (JP); Koji Shimizu, Hirakata (JP); Tomohiro Kawase, Hirakata (JP); Naoyuki Omura, Hirakata (JP); Toshihisa Isono, Hirakata (JP); Kazuyoshi Nishimoto, Hirakata (JP)

(73) Assignee: C. Uyemura & Co., Ltd., Osaka-Shi (JP)

( * ) Notice: Subject to any disclaimer, the term of this patent is extended or adjusted under 35 U.S.C. 154(b) by 450 days.

(21) Appl. No.: 12/179,352

(22) Filed: Jul. 24, 2008

(65) Prior Publication Data

US 2009/0026083 A1 Jan. 29, 2009

(30) Foreign Application Priority Data

Jul. 27, 2007 (JP) ..... 2007-195827

(51) Int. Cl.
*C25D 21/18* (2006.01)
*C25B 9/00* (2006.01)

(52) U.S. Cl. ..... 205/101; 204/232

(58) Field of Classification Search ..... 205/101
See application file for complete search history.

(56) References Cited

U.S. PATENT DOCUMENTS 5,143,593 A 9/1992 Ueno et al.
6,350,362 B1 * 2/2002 Geisler et al. ..... 205/101
6,835,294 B2 12/2004 Tsuchida et al.
6,899,803 B2 * 5/2005 Matejat et al. ..... 205/101
2002/0153254 A1 * 10/2002 Belongia et al. ..... 205/101
2004/0069647 A1 * 4/2004 Mizohata et al. ..... 205/101
2009/0026083 A1 1/2009 Tachibana et al.

FOREIGN PATENT DOCUMENTS

JP 62280374 A * 12/1987
JP 3-97887 A 4/1991
JP 2003-55800 A 2/2003
JP 2003-166100 A 6/2003
JP 2004-143478 A 5/2004
JP 2005-187869 A 7/2005

OTHER PUBLICATIONS

Machine Translation of JP 2005-187869.*
English Abstract of JP 62-280374.*

* cited by examiner

*Primary Examiner* — Harry D Wilkins, III
*Assistant Examiner* — Bryan D. Ripa
(74) *Attorney, Agent, or Firm* — Birch, Stewart, Kolasch & Birch, LLP

(57) ABSTRACT

A continuous copper electroplating method wherein copper is continuously plated on a workpiece to be placed in a plating vessel accommodating a copper sulfate plating bath containing organic additives by use of a soluble or insoluble anode and a workpiece as a cathode, the method including overflowing the plating bath from the plating vessel in an overflow vessel under which the plating bath in the overflow vessel is returned to the plating vessel, providing an oxidative decomposition vessel, and returning a plating bath from the oxidative decomposition vessel through the overflow vessel to the plating vessel to circulate the plating bath between the plating vessel and oxidative decomposition vessel, and metallic copper is immersed in the plating bath in the oxidative decomposition vessel and exposed to air bubbling, so that decomposed/degenerated organic products formed by decomposition or degeneration produced during the copper electroplating can be oxidatively decomposed.

4 Claims, 6 Drawing Sheets

CONTINUOUS COPPER ELECTROPLATING METHOD

CROSS-REFERENCE TO RELATED APPLICATION

This non-provisional application claims priority under 35 U.S.C. §119(a) on Patent Application No. 2007-195827 filed in Japan on Jul. 27, 2007, the entire contents of which are hereby incorporated by reference.

BACKGROUND OF THE INVENTION

1. Field of the Invention

This invention relates to a method for the continuous electroplating of copper on workpieces to be plated by use of a copper sulfate plating bath.

2. Description of the Related Art

In the formation of patterns of printed circuit boards or wafers, copper sulfate electroplating is carried out. This copper sulfate plating bath containing organic additives called brightener, leveler, promoter, controlling agent and the like. In this connection, however, it is known that in the course of continuous plating, these organic additives are decomposed or degenerated (a compound or compounds obtained after decomposition or degeneration may be sometimes called hereinafter decomposed/degenerated organic product or products), so that a desired copper plating film or copper plating deposition is not obtained. In order to avoid copper slime generated owing to the use of a phosphorus-containing copper anode from being incorporated into a plating film, a copper sulfate plating process has been adopted using an insoluble anode. Where continuous plating is carried out, not only there arises a problem on the above-mentioned decomposed/degenerated organic products, but also copper ions and organic additives in the plating bath are reduced in amount, for which it becomes necessary to control the missing copper ions and organic additives by replenishment.

In such a copper sulfate electroplating method, it is essential to avoid the problem on the above decomposed/degenerated organic products and also to continuously perform copper sulfate electroplating while replenishing plating components and keeping the characteristics of the plating film. Prior art technique of copper sulfate electroplating includes those indicated below.

Japanese Patent Laid-Open No. Hei 3-97887:

In this document, air agitation is carried out in a separate vessel provided with a copper metal in current-off condition so as to replenish copper ions. Since the supply of the copper ions and the decomposition of decomposed/degenerated organic products are carried out in the same vessel, so that exact controls of the maintenance of copper ion concentration and the oxidative decomposition of the decomposed/degenerated organic products are incompatible, thereby disenabling the characteristics of plating film to be maintained.

Japanese Patent Laid-Open No. 2003-55800:

Blank electrolysis is carried out in a separate vessel by use of an insoluble anode, and decomposed/degenerated organic products are reduced in amount by oxidative decomposition by means of oxygen generated from the insoluble anode. However, when plating is continuously performed, it takes too long a time to satisfactorily decompose the decomposed/degenerated organic products by oxidation, thus presenting a problem from a practical standpoint.

Japanese Patent Laid-Open No. 2003-166100:

This document describes a method in which iron ions are contained in a copper sulfate plating bath as a redox material, and copper power is added to the plating bath in a separate vessel. However, since iron ions are contained, the iron ions may be co-deposited in the resulting plating film and thus, the characteristics of the plating film cannot be maintained.

Japanese Patent Laid-Open No. 2004-143478:

Air agitation is carried out in a separate vessel so as to increase an amount of dissolved oxygen in a plating bath, in which decomposed/degenerated organic products are oxidatively decomposed. However, only the air agitation disenables the oxidative decomposition of the decomposed/degenerated organic products to proceed satisfactorily. Although it may be possible to make the air agitation strong, stronger air agitation leads to larger-sized bubbles being returned to the plating vessel. When the large-sized bubbles are incorporated into the plating vessel, the bubbles attach to a workpiece being plated, thereby causing a plating failure such as non-plating.

Japanese Patent Laid-Open No. 2005-187869:

In a separate vessel, copper is provided in current-off condition and air agitation is carried out to control such organic additives as set out hereinabove. Simultaneously, the concentration of copper ions is held in another copper dissolution vessel, and the copper ions dissolved in the copper dissolution vessel are transferred to the separate vessel. In this case, in order to replenish the shortage of the copper ions, it is necessary to continuously return, to a plating vessel, a given amount of the plating bath in the copper dissolution vessel in correspondence with the consumption of the copper ions. In this condition, when the decomposed/degenerated organic products are accumulated, the plating bath is returned to the plating vessel even under conditions where the oxidative decomposition of the organic additives is not satisfactory. Accordingly, it is not possible to control both the concentration of copper ions and the oxidative decomposition of organic additives. Only one decomposition vessel for the oxidative decomposition of the decomposed/degenerated organic products is used, so that if the oxidative decomposition treatment is carried out under conditions of continuously circulating the plating bath, the plating bath has to be returned to the plating vessel before oxidative decomposition of the decomposed/degenerated organic products does not proceed satisfactorily. On the other hand, when the oxidative decomposition treatment is carried out in a batchwise manner, the solution level in the plating vessel differs between the case where the plating bath is filled in the decomposition vessel and the case where not filled, thereby causing a plating failure.

SUMMARY OF THE INVENTION

The present invention has been made under these circumstances in the art and has for its object the provision of a continuous copper electroplating method wherein when copper electroplating on a workpiece to be plated, such as a printed circuit board or the like, is continuously carried out by use of a copper sulfate plating bath, decomposed/degenerated organic products (decomposed organic products and/or degenerated organic products), which are formed upon continuous electroplating using a copper sulfate plating bath and are produced by decomposition or degeneration of organic additives, are efficiently oxidatively decomposed thereby avoiding a problem on the decomposed/degenerated organic products. Another object is to provide a continuous copper electroplating method wherein while efficiently replenishing components in a plating bath consumed by plating in such a way that the plating bath in a plating vessel is reduced in quantitative and qualitative variation, a deposition failure of and voids in a copper plating film are reduced to an extent as small as possible and copper sulfate electroplating can be continuously performed while keeping the characteristics of the plating film.

In order to achieve the above objects, there is provided according to the invention a continuous copper electroplating method wherein copper is continuously electroplated on a workpiece to be plated in a plating vessel accommodating a copper sulfate plating bath containing organic additives by use of a soluble or insoluble anode and a cathode made of the workpiece to be plated, the method including providing an overflow vessel accommodating a plating bath overflowing from the plating vessel and provided adjacent to the plating vessel, returning the plating bath from the overflow vessel to the plating vessel while permitting the plating bath to overflow from the plating vessel into the overflow vessel, providing an oxidative decomposition vessel different from the plating vessel and transferring the plating bath to the oxidative decomposition vessel, and returning the plating bath from the oxidative decomposition vessel via the overflow vessel to the plating vessel thereby circulating the plating bath between the plating vessel and the oxidative decomposition vessel, and metallic copper is immersed in the plating bath in the oxidative decomposition vessel to expose the metallic copper to air bubbling whereby while dissolving the metallic copper as copper ions in the oxidative decomposition vessel, decomposed/degenerated organic products produced by decomposition or degeneration of the organic additives in the course of the copper electroplating are subjected to oxidative decomposition treatment on the surface of the metallic copper by non-electrolytic oxidation action independent from an electric current applied between the anode and the cathode.

The invention is directed to a continuous copper electroplating method wherein a copper sulfate plating bath containing organic additives is used, a soluble anode or insoluble anode is used as an anode, and a cathode used is a workpiece to be plated. In the practice of the invention, the oxidative decomposition vessel different from the plating vessel is provided aside from the plating vessel, and metallic copper is immersed in the plating bath in the oxidative decomposition vessel to subject the metallic copper to air bubbling. As a consequence, the metallic copper is dissolved as copper ions, and decomposed/degenerated organic products produced by decomposition or degeneration of organic additives in the course of copper electroplating, e.g. oxidized organic products produced by decomposition or degeneration of the organic additives by incomplete oxidation reactions, are oxidatively decomposed by non-electrolytic oxidation action, which is independent from an electric current applied between the anode and the cathode, on the surface of the immersed metallic copper. In this way, the influence of the decomposed/degenerated organic products produced through the continuous copper electroplating can be eliminated as smoothly as possible thereby ensuring the copper electroplating while continuously, stably keeping plating characteristics.

For the immersion of the metallic copper in the plating bath in the oxidative decomposition vessel, there is adopted a method wherein the metallic copper is fixedly suspended at the wall of the oxidative decomposition vessel, into which a plating bath is introduced to allow the copper to be immersed. Alternatively, there may be used a method wherein after the introduction of a plating bath into the oxidative decomposition vessel, metallic copper is immersed in the plating bath. In this case, the metallic copper is immersed in a current-off condition. No limitation is placed on the metallic copper, and there maybe used copper sheets, copper plating film-bearing workpieces, phosphorus-containing copper balls and the like. In order to enhance the decomposition action of decomposed/degenerated organic products, a larger immersion area of the metallic copper is better. From this standpoint, it is preferred to use phosphorous-containing copper balls.

In the practice of the invention, an overflow vessel for accommodating a plating bath overflowing from the plating vessel is provided adjacent to the plating vessel, and the plating bath in the overflow vessel is returned to the plating vessel while permitting the plating bath to overflow from the plating vessel to the overflow vessel. At the same time, a plating bath from an oxidative decomposition vessel is returned to the overflow vessel, thereby circulating the plating bath between the plating vessel and the overflow vessel. In this case, decomposed/degenerated organic products are decomposed by oxidative decomposition treatment in the oxidative oxidation vessel, so that the plating bath whose quality is changed over the plating bath accommodated in the plating vessel is introduced into the plating vessel after mixing with the plating bath in the overflow vessel beforehand. This enables a concentration gradient in the plating bath in the plating vessel, in which plating is continuously performed, to be made smaller by means of the returned plating bath over the case where the plating bath after the oxidative decomposition treatment is directly returned to the plating vessel, thereby ensuring a smaller quantitative variation of the plating bath.

It will be noted that the overflow vessel is one that accommodates a plating bath overflowing from the plating vessel. In the overflow vessel, dirt and dust floating in the plating bath at or near the surface level thereof can be collected. So far as the above purposes are satisfied, this vessel may be directly mounted in the plating vessel or may be separately disposed. In order to achieve space saving, it is preferred to constitute the overflow vessel integrally with the plating vessel at an outer wall thereof.

In the practice of the invention, it is preferred that two oxidative decomposition vessels arranged in parallel to each other are provided, under which a step of performing the oxidative decomposition treatment in one-line oxidative decomposition vessel charged with a plating bath and a step of introducing and charging a plating bath from an overflow vessel into the other line oxidative decomposition vessel not charged with a plating bath while returning a treated plating bath from the one-line oxidative decomposition vessel to the overflow vessel are alternately repeated in the respective line oxidative decomposition vessels.

In this case, during the time at which oxidative decomposition treatment is carried out in the one-line of the oxidative decomposition vessels, no oxidative decomposition treatment is carried out without charging a plating bath in the other line oxidative decomposition vessel. Hence, there can be adopted a batch system wherein the oxidative decomposition treatment is carried out alternately between the one-line vessel and the other line vessel. In this way, satisfactory oxidative decomposition treatment is performed in the respective batches and the resulting plating bath can be returned to the plating vessel. While the plating bath after the treatment can be returned from the one-line oxidative decomposition vessel to the overflow vessel, the plating bath from the overflow vessel is introduced and charged into the other line oxidative decomposition vessel not charged with a plating bath. Thus, transfers of these baths are simultaneously performed, so that the plating bath in the plating vessel wherein plating is continuously carried out is suppressed from variation in solution level. Additionally, the quantitative variation of the plating bath in the plating vessel can be eliminated as small as possible thereby ensuring copper electroplating while continuously, stably keeping plating characteristics.

In this case, it is preferred that when the plating bath after the oxidative decomposition treatment is introduced into the other line oxidative decomposition vessel, a discharge amount of the plating bath from the overflow vessel is so set that the plating bath is transferred, within a range where the overflow vessel is not empty, in amounts invariably larger than an introduction amount of the plating bath from the one-line oxidative decomposition vessel in case where the plating bath is returned to the overflow vessel after the oxidative decomposition treatment. In doing so, the time required for the introduction of the plating bath into the oxidative decomposition vessel can be shortened, thereby ensuring a time during which the decomposed/degenerated organic products can be decomposed more reliably. The amount of introduction of the plating bath returned to the overflow vessel after the oxidative decomposition treatment has to be smaller than the discharge amount. In this case, it is preferred that a circulation pump for returning the plating bath is constantly operated in order to introduce the plating bath. This is because the variation of the solution level in the overflow vessel caused by an increasing amount of discharge into the oxidative decomposition can be mitigated, thus leading to the ease in controlling the overflow vessel as not being empty. When the plating bath is introduced by constant operation of the circulation pump for returning the plating bath, a local, abrupt variation of the concentration, composition and the like of the plating bath in the plating vessel can be suppressed, thereby making it possible to stably realize copper electroplating without causing plating failure.

The plating bath can be transferred in such a way that a discharge amount of the plating bath from the overflow vessel at the time of introducing the plating bath into the other line oxidative decomposition vessel after the oxidative decomposition treatment and an introduction amount of the plating bath from the one-line oxidative decomposition vessel at the time of returning the plating bath to the overflow vessel after the oxidative decomposition treatment may be made substantially equal to each other. In this connection, however, if the plating bath is transferred so that the discharge amount is invariably made greater than the introduction amount, the amount of the plating bath in the plating vessel does not become relatively large in the course of the transfer of the plating bath between the plating vessel and the oxidative decomposition vessel (i.e. there is no possibility that the solution level becomes excessively high and the plating bath overflows from the plating vessel or the overflow vessel to cause dirt floating on or in the surface of the plating bath to be entrained in the plating vessel). On the contrary, the plating bath in the plating vessel can be relatively reduced in amount when transferred, with the attendant advantage that the plating bath can be transferred while more stably keeping the solution level by utilizing the buffer action on the solution level in the overflow vessel. Thus, the quantitative variation of the plating bath in the plating vessel can be further suppressed, thereby enabling copper electroplating while continuously, stably keeping plating characteristics.

It will be noted that although a discharge amount ($Q_A$) of the plating bath from the overflow vessel in the course of the introduction of the plating bath into the other line oxidative decomposition vessel after the oxidative decomposition treatment and an introduction amount ($Q_B$) of the plating bath from the one-line oxidative decomposition vessel in the course of return of the plating bath to the overflow vessel after the oxidative decomposition treatment can be, for example, so set that $1<Q_A/Q_B \leqq 10$, it is necessary that the overflow vessel do not become empty. The discharge amount means a discharge amount of a plating bath per given unit time and can be arbitrarily set depending on the bath capacity of the overflow vessel. In order not to make the overflow vessel empty, the discharge amount may be set within a range of a residual amount obtained by subtracting a suction amount of the bath sucked through constantly operated circulation and agitation from the capacity of the bath in the overflow vessel. On the other hand, a solution level sensor may be provided within the overflow vessel so that if the plating bath in the overflow vessel arrives at a given level, the discharge of the plating bath into the oxidative decomposition vessel is stopped. This can simply prevent the overflow vessel from being empty if the discharge amount is set at a great level.

In the practice of the invention, a soluble or insoluble anode can be used as an anode. Where a soluble anode is employed, for example, phosphorus-containing balls are accommodated in a basket made of titanium or the like as is well known in the art. The basket is covered with an anode bag made of polypropylene or the like and is immersed in a plating bath in a plating vessel, followed by application of an electric current thereto. On the other hand, where an insoluble anode is used, copper ions consumed by copper electroplating in the plating bath have to be appropriately replenished by supply means other than an anode. In the invention, copper ions are, more or less, replenished by dissolution of metallic copper in the oxidative decomposition vessel. In general, this is insufficient to supply an adequate amount of copper ions and thus, it is preferred to separately replenish copper ions by providing means for supplying copper ions. It is preferred that when an insoluble anode is used, the anode is covered with an anode bag made of polypropylene or an ion exchange membrane is provided between it and a cathode so as not to permit a gas generated from the anode to be moved toward a workpiece to be plated and therearounds.

Where copper ions are replenished by separate provision of means for supplying copper ions, a copper dissolution vessel different from the plating vessel and oxidative decomposition vessel is provided. The plating bath is transferred to the copper dissolution vessel, and the plating bath is returned from the copper dissolution vessel through the overflow vessel to the plating vessel so that the plating bath is circulated between the plating vessel and the copper dissolution vessel. Copper oxide is charged into the copper dissolution vessel for dissolution, with the possibility that copper ions in the plating bath consumed by plating can be replenished.

In this case, the copper dissolution vessel may be provided as a separate vessel different from both of the plating vessel and the oxidative decomposition vessel. To this end, the replenishment of copper ions and the oxidative decomposition treatment are performed as being completely separated from each other, and plating baths can be individually returned to the plating bath. Thus, the feed of copper ions and the oxidative decomposition treatment can be independently controlled, enabling more exact control of components in the plating bath.

When the plating bath from the copper dissolution vessel is returned to the overflow vessel, there can be obtained a plating bath whose copper concentration increases in the copper dissolution vessel. This plating bath is mixed with the plating bath in the overflow vessel beforehand and introduced into the plating vessel. In this way, when compared with the case where the plating bath having a high copper concentration is directly returned to the plating vessel, the plating bath in the plating vessel wherein plating is continuously carried out can be made smaller in concentration gradient upon returning of the plating bath, thereby ensuring a smaller qualitative variation in the plating bath.

Further, it is preferred in the invention that when the overflow vessel is constituted of first and second overflow vessels which are communicated with each other to permit mutual movement of plating baths. In this case, a plating bath from the first overflow vessel is returned to the plating vessel and a plating bath from the second overflow vessel is introduced into the oxidative decomposition vessel to perform the oxidative decomposition treatment. The plating bath after the oxidative decomposition treatment is introduced from the oxidative decomposition vessel into the first overflow vessel thereby circulating the plating bath between the plating vessel and the oxidative decomposition vessel.

In this way, the overflow vessel is constituted of two overflow vessels including a first overflow vessel in which a plating bath overflowing from the plating vessel flows and a plating bath after the oxidative decomposition treatment is introduced, and thus, these plating baths are mainly transferred to the plating vessel, and a second overflow vessel in which a plating bath overflowing from the plating vessel flows and this plating bath is mainly transferred to the oxidative decomposition vessel. These vessels are communicated with each other so that the plating baths are mutually movable. Since the first and second overflow vessels are communicated with each other, the plating baths accommodated in both vessels become equal with respect to the solution level thereof. The streams of the plating baths overflowing from the plating vessel in both overflow vessels are made equal in amount. The overflowing streams and the level of the plating bath in the plating vessel can be stabilized.

In this case, according to the oxidative decomposition treatment in the oxidative decomposition vessel, decomposed/degenerated organic products are decomposed. Accordingly, a plating bath whose quality is changed over the plating bath accommodated in the plating vessel is introduced into the plating vessel after preliminary mixing with the plating bath in the second overflow vessel. Thus, when compared with the case where the plating bath after the oxidative decomposition treatment is directly returned to the plating vessel, the concentration gradient caused by the addition of the returned plating bath in the plating bath in the plating vessel wherein plating is continuously performed can be made smaller, thereby making a smaller qualitative variation of the plating bath. The return of the plating bath after the oxidative decomposition treatment is reduced as small as possible, and the plating bath having been subjected to the oxidative decomposition treatment can be returned to the plating vessel simultaneously with the decomposition treatment.

More particularly, the stabilization of the plating bath level in the plating vessel can be well balanced with an efficient return of the plating bath after the oxidative decomposition treatment to the plating vessel while keeping the quantitative stability of the plating bath in the plating vessel.

Further, a copper dissolution vessel different from the plating vessel and the oxidative decomposition vessel may be provided wherein the plating bath is transferred from the second overflow vessel to the copper dissolution vessel and further the plating bath is transferred from the copper dissolution vessel to the first overflow vessel thereby circuiting the plating bath between the plating vessel and the copper dissolution vessel. In the copper dissolution vessel, copper oxide is charged for dissolution. Thus, copper ions in the plating bath consumed by plating can be replenished.

In this connection, the copper dissolution vessel is provided as a separate vessel different from the plating vessel and the oxidative decomposition vessel. Hence, the replenishment or supplement of copper ions and the oxidative decomposition treatment can be completely separately carried out. Individual plating baths can be returned to plating baths. The supply of copper ions and the oxidative decomposition can be independently controlled, ensuring more exact component control in the plating bath.

When the plating bath from the copper dissolution vessel is returned to the first overflow vessel, the plating bath whose copper concentration increases in the copper dissolution vessel is introduced into the plating vessel after pre-mixing with a plating bath in the first overflow vessel. Accordingly, when compared with the case where a plating bath having a high copper concentration is directly returned to the plating vessel, the concentration gradient, caused by the addition of the returned plating bath, in the plating bath in the plating vessel wherein plating is continuously performed can be made smaller, thereby making a smaller qualitative variation of the plating bath.

When copper electroplating is continuously performed, components other than copper ions, such as organic additives and the like are also replenished. In the practice of the invention, it is preferred that a replenishing solution of components other than copper, which are consumed by plating in the plating bath is introduced into the first overflow vessel to supply the components other than copper.

Since a highly concentrated replenishing solution is introduced into the first overflow vessel, the replenishing solution is introduced into the plating vessel after pre-mixing with the plating bath in the first overflow vessel. Accordingly, when compared with the case where a highly concentrated replenishing solution is directly returned to the plating vessel, the concentration gradient, caused by the addition of the returned plating bath, in the plating bath in the plating vessel wherein plating is continuously performed can be made smaller, thereby making a smaller qualitative variation of the plating bath.

Further, it is preferred that a discharge amount per unit time of the plating bath from the first overflow vessel is invariably made higher than a discharge amount per unit time of the plating bath from the second overflow vessel.

The first overflow vessel is introduced thereinto with (a) a plating bath introduced from the oxidative decomposition vessel after the oxidative decomposition vessel, (b) a plating bath introduced from the copper dissolution vessel and replenished with copper ions, and (c) a replenishing solution of components other than copper ions. When a discharge amount per unit time of a plating bath from the first overflow vessel is invariably made greater than a discharge amount per unit time of a plating bath from the second overflow vessel, a plating bath including these baths can be returned to the plating vessel more selectively and more efficiently, along with an advantage in that the outflow of a plating bath from the first overflow vessel, into which the plating baths to be introduced into the plating vessel and subjected to plating (i.e. the baths (a) to (c) indicated above) are introduced, to the second overflow vessel can be avoided.

It will be noted that a discharge amount ($Q_C$) per unit time of a plating bath from the first overflow vessel and a discharge amount ($Q_D$) per unit time of a plating bath from the second overflow vessel can be set, for example, such that $1<Q_C/Q_D\leqq 10$. The discharge amount means a discharge amount per given unit time of a plating bath and can be arbitrarily set depending on the plating bath capacity in the overflow vessel.

Although the oxidative decomposition vessel is provided separately from the plating vessel, there may be used, in combination, an oxidative decomposition device of a type wherein metallic copper balls in current-off state are accommodated in a basket insoluble in a copper sulfate plating bath in the plating vessel, covered with a bag such as of polypropylene and suspended at a wall of the plating vessel and immersed in the plating bath, and the metallic copper in the bag is subjected to air bubbling. The oxidative decomposition device used is of a type shown in FIGS. 6A, 6B and 7.

FIG. 6A shows a metallic copper accommodating container 70 wherein metallic copper (metallic copper balls) 7 is accommodated in a meshwork basket 8 formed of a material such as titanium, which does not undergo dissolution or corrosion in the plating bath. An L-shaped hook 9 formed as being suspended at a wall of a plating vessel is provided at the top of the basket 8. FIG. 6B shows an oxidative decomposition device 80 wherein four metallic copper accommodating containers 70 are assembled as one unit (although not limited to four in number of assembly containers, and one, two, three or five or more may be assembled), and two air nozzles 71 (although not limited in number, and one or three or more may be used) are each provided between adjacent metallic copper accommodating containers 70. With the case of FIG. 6B, the meshwork bag 72 formed of polypropylene (a basket-shaped meshwork in this figure) is fixed to the metallic copper accommodating containers 70 by fixing means (not shown), and the four metallic copper accommodating containers 70 and the two air nozzles 71 are separated from one another in such a way that the plating bath movably surround the bag 72 from the inside and outside thereof.

This oxidative decomposition device 80 allows metallic copper 7 to be immersed in a plating bath b by mounting a hook 9 of the metallic copper accommodating container 70 at an upper portion of a side wall of the plating vessel 1 and suspending within the plating vessel 1. A given amount of air is blown from an air nozzle 71 from below the metallic copper 7 by use of a flow control device (e.g. a valve, a flow meter and the like (not shown)) to feed bubbles of air in the vicinity of the metallic copper 7, thereby causing the bubbles to be contacted with the metallic copper 7. In this case, little bubbles are escaped to outside by means of the bag 72.

Using the oxidative decomposition device and the oxidative decomposition vessel in combination as set out above, copper electroplating can be stably performed over a long time without suffering a plating failure.

As will be apparent from the above, according to the invention decomposed/degenerated organic products formed by decomposition or degeneration of organic additives in a copper sulfate plating bath can be efficiently oxidized and decomposed to avoid the problem on the decomposed/degenerated organic products. In addition, while effectively replenishing plating components, copper sulfate electroplating can be continuously performed while keeping the characteristics of the resulting film.

BRIEF DESCRIPTION OF THE DRAWINGS

FIGS. 6A and 6B are, respectively, views showing an example of means for immersing metallic copper in a plating bath wherein FIG. 6A shows a metallic copper accommodating container accommodating metallic copper and FIG. 6B shows an oxidative decomposition device including a metallic copper accommodating container, an air nozzle and bubble diffusion preventing means assembled together.

DETAILED DESCRIPTION OF THE PREFERRED EMBODIMENT

Figure 1:
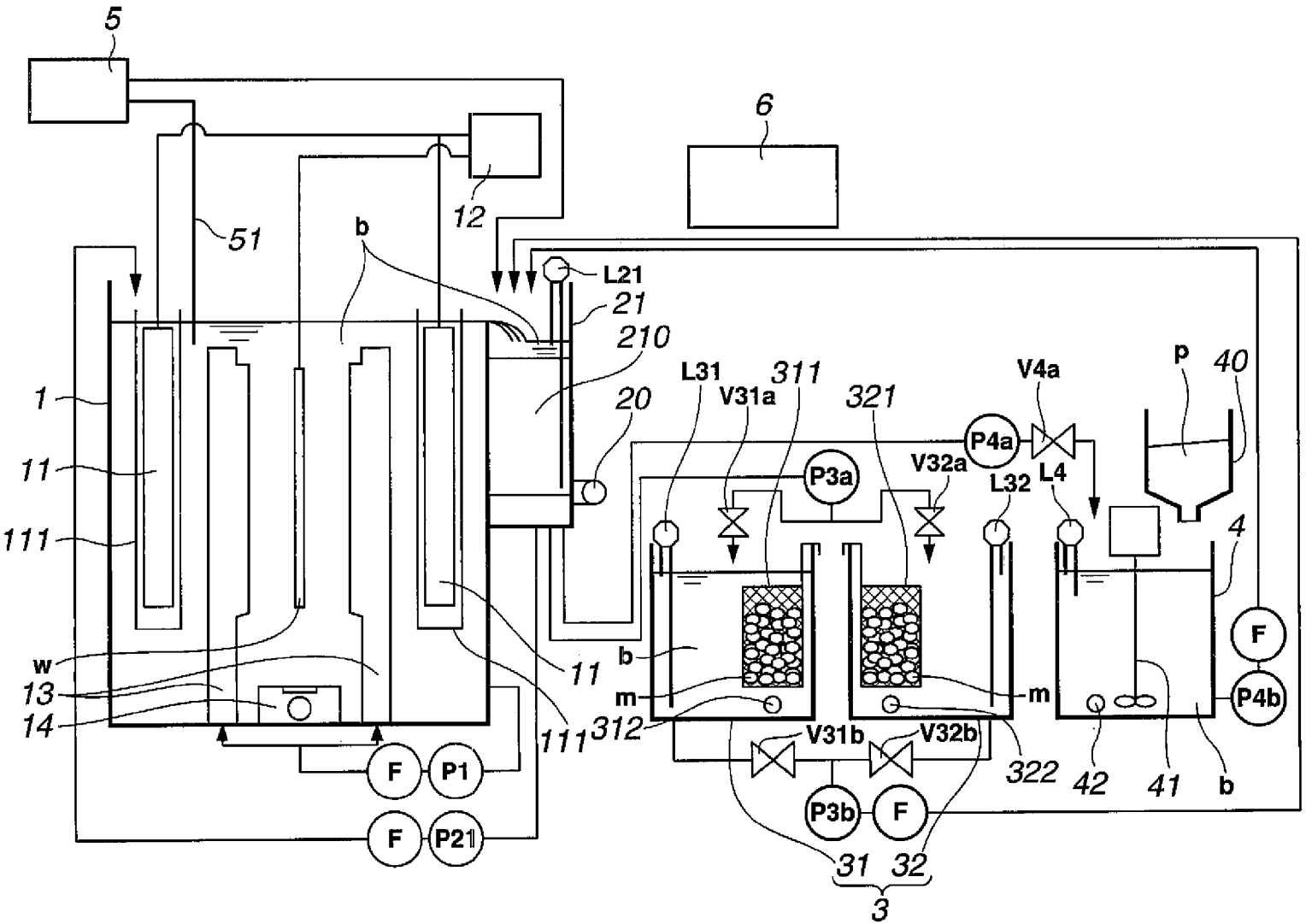
FIG. 1 is a schematic view showing an example of a plating apparatus favorably adaptable to a continuous copper electroplating method of the invention and shows a state where a plating bath is charged in a one-line oxidative decomposition vessel and the other line oxidative decomposition vessel is empty.
Figure 2:
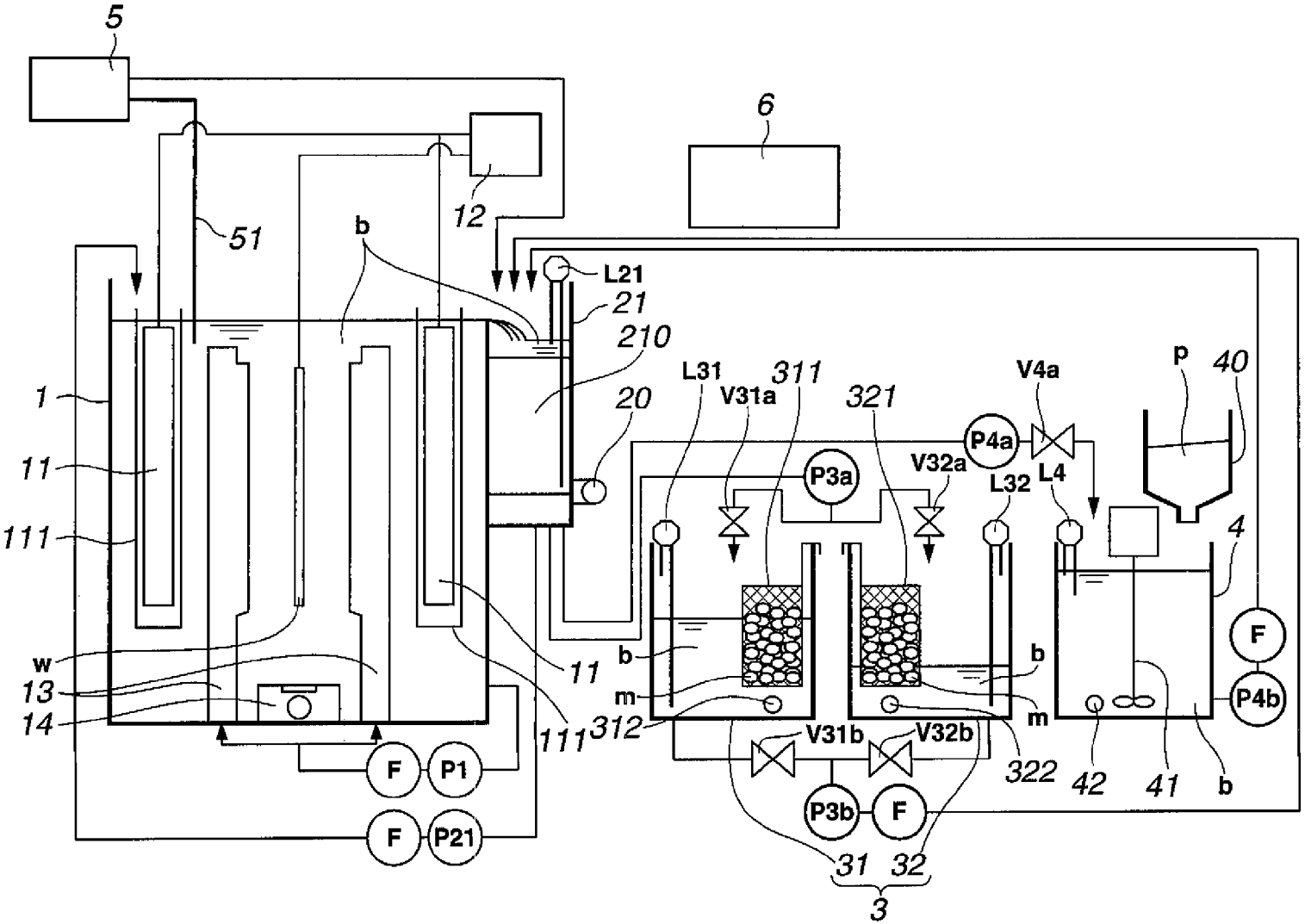
FIG. 2 is a schematic view showing an example of a plating apparatus favorably adaptable to a continuous copper electroplating method of the invention and shows a process wherein a plating bath is discharged from a one-line oxidative decomposition vessel and a plating bath is introduced into the other line oxidative decomposition vessel.
Figure 3:
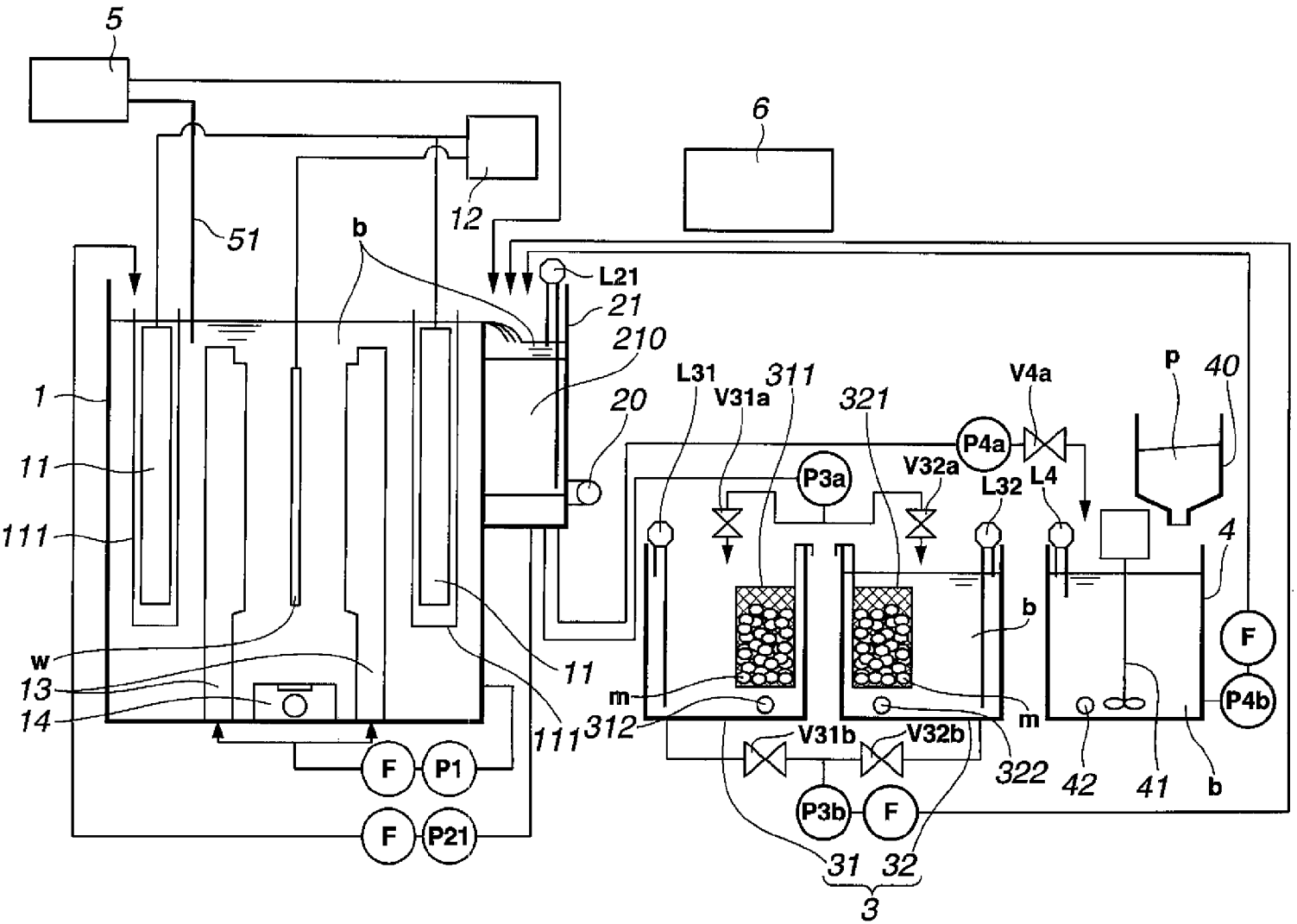
FIG. 3 is a schematic view showing an example of a plating apparatus favorably adaptable to a continuous copper electroplating method of the invention and shows a state where a plating bath fill in the other line oxidative decomposition vessel and an one-line oxidative decomposition vessel is empty.

The invention is now described in more detail with reference to the accompanying drawings.

FIGS. 1 to 5 are, respectively, a schematic view showing an instance of a plating apparatus, to which a continuous copper electroplating method of the invention is conveniently applicable. In the figures, indicated by 1 is a plating vessel, by 21, 22, 23 are, respectively, an overflow vessel, by 3 is an oxidative decomposition vessel constituted of two oxidative decomposition vessels 31, 32 and by 4 is a copper dissolution vessel.

A plating bath b is accommodated in the plating vessel 1, and two insoluble anodes 11, 11 are immersed in the plating bath b. A workpiece w to be plated (six plate-shaped substrates in this case) serving as a cathode is immersed between the two insoluble anodes. In this case, the insoluble anodes 11, 11 are, respectively, covered with anode bags 111, 111. These insoluble anodes 11, 11 and the workpiece w to be plated are connected to the respective rectifiers 12, to which is an electric current is applied from an electric power supply (not shown). A plurality of jet nozzles 13 are so arranged in the plating vessel 1 as to be facing each other at opposite sides of the workpiece w to be plated, so that the plating bath b taken out from the plating vessel 1 is passed through a filter F by means of a pump P1 and jetted against the opposite sides of the workpiece w to be plated. Moreover, an air agitator 14 is provided at the bottom of the plating vessel 1 and is located below the workpiece w along the directions of the opposite sides thereof.

Three overflow vessels (although not limited in number of the overflow vessels) 21, 22, 23 are provided adjacent to each other. The overflow vessels 21, 22, 23 are so arranged that the plating bath b flows over the upper end of the walls (i.e. the walls separating the plating vessel 1 and the overflow vessels 21, 22, 23) of the plating vessel 1 at portions thereof in contact with the respective overflow vessel 21, 22, 23 and enters into the overflow vessels 21, 22, 23.

Figure 4:
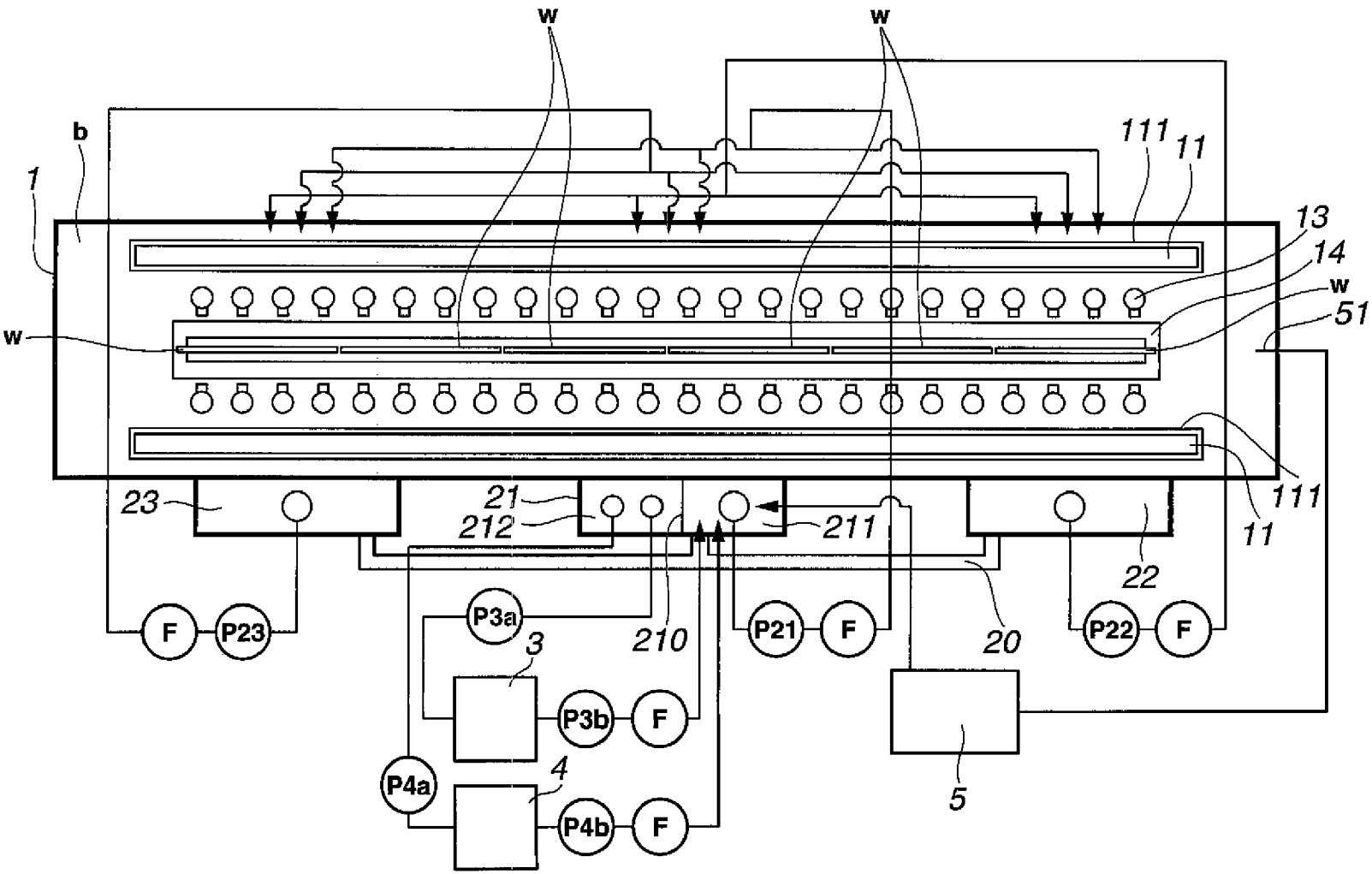
FIG. 4 is a schematic plan-view showing a plating vessel and an overflow vessel of the plating apparatus of FIGS. 1 to 3, showing an arrangement of an oxidative decomposition vessel, a copper dissolution vessel and an on-line analysis feeder.
Figure 5:
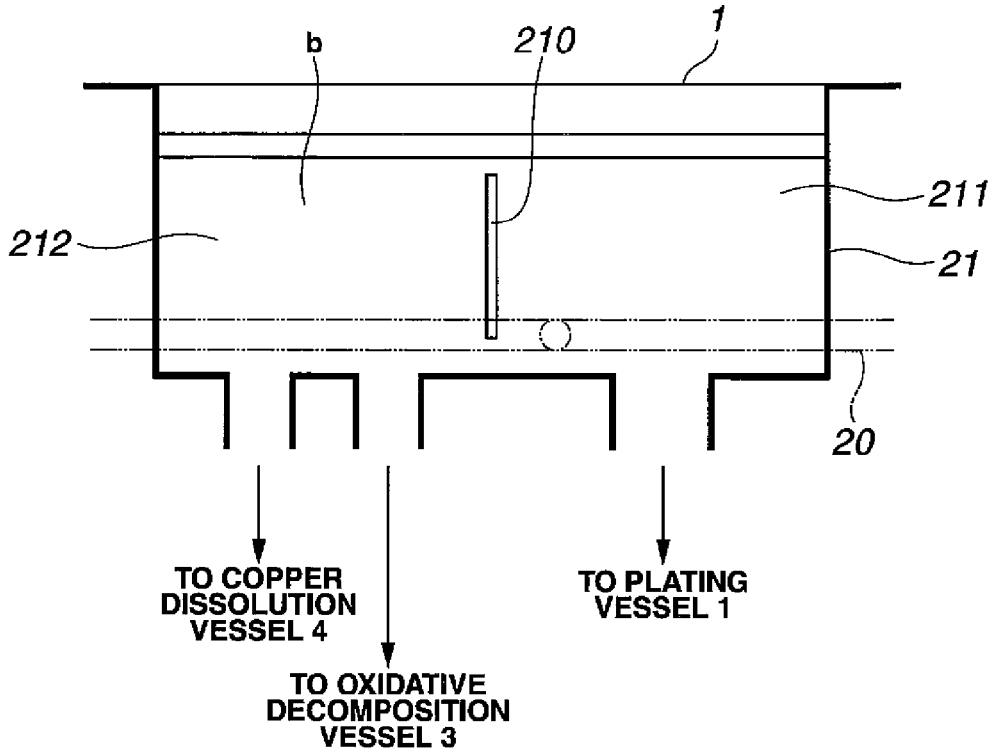
FIG. 5 is an enlarged sectional view of part of the overflow vessel provided with first and second vessels.
Figure 6A:
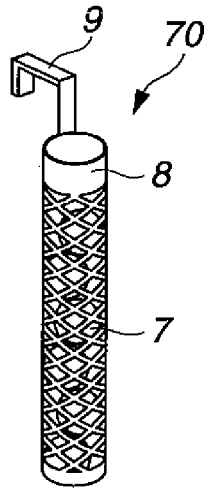
Figure 6B:
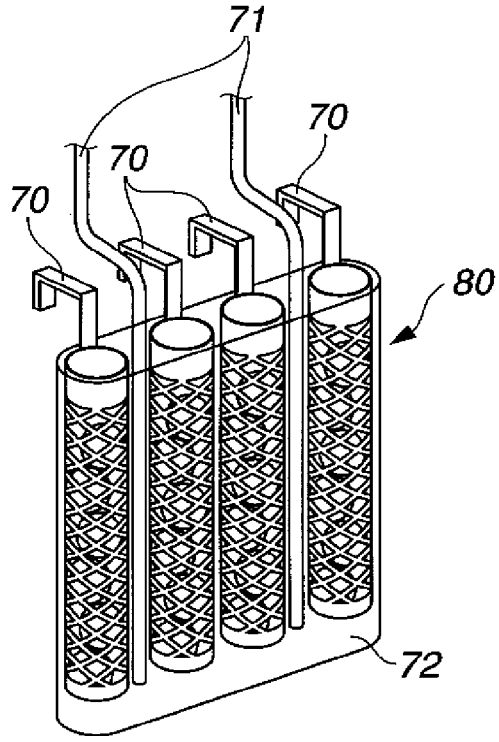
Figure 7:
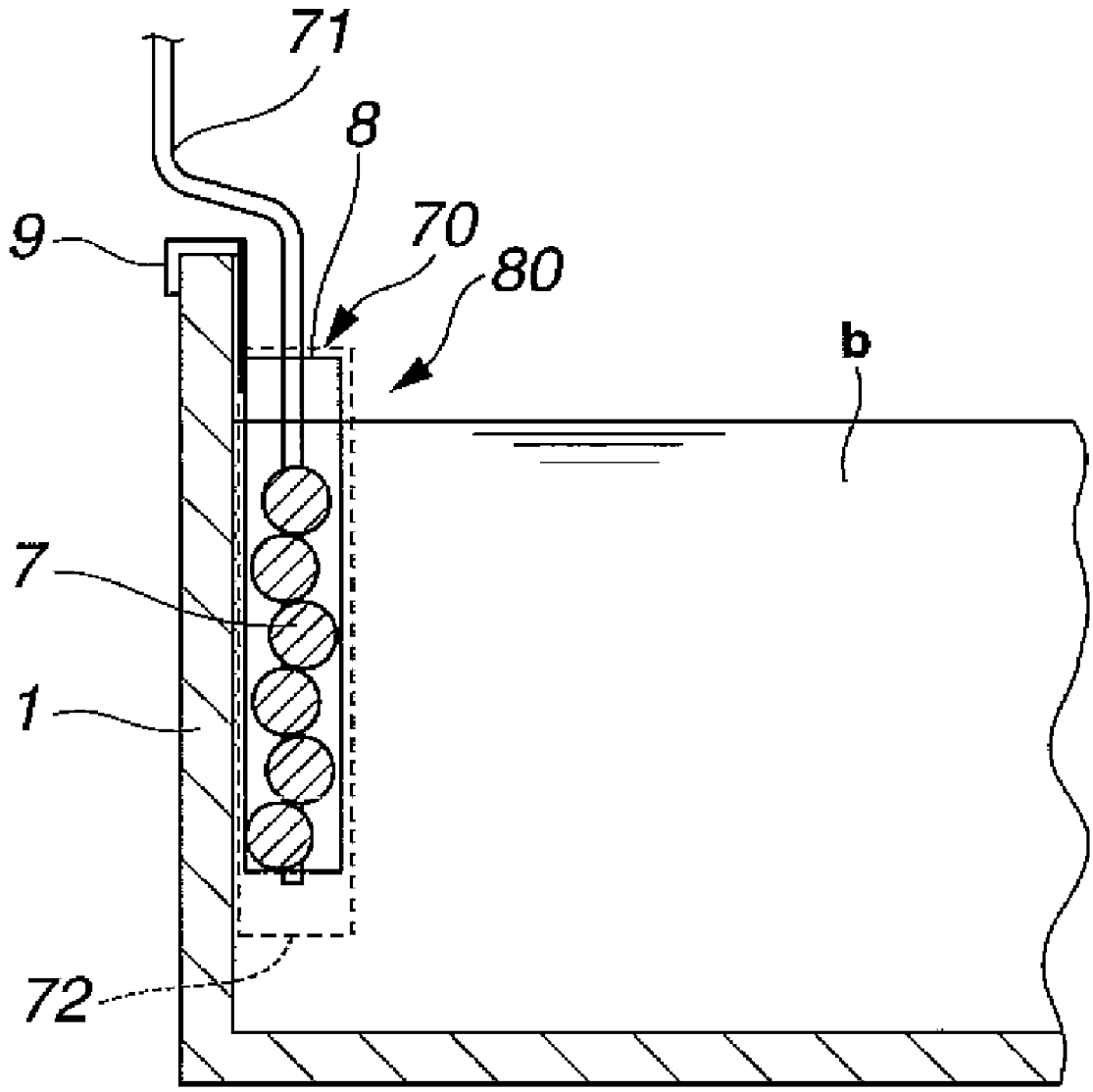
FIG. 7 is a sectional view showing an example of a state wherein metallic copper is immersed in a plating bath by use of an oxidative decomposition device.

In this instance, three overflow vessels 21, 22, 23 are provided as the overflow vessel as is particularly shown in FIG. 4. The overflow vessel 21 is divided into a first vessel (first overflow vessel) 211 and a second vessel (second overflow vessel) 212 by means of a partition board 210 as shown in FIG. 5. The partition board 210 does not arrive at the inner bottom surface of the overflow vessel 21, so that the first vessel 211 and the second vessel 212 communicate with each other, thereby permitting the plating bath b to be mutually movable therethrough. The plating bath b discharged from the bottom of the first vessel 211 is returned to the plating vessel 1 through the filter F by means of the pump P21 (in this instance, the bath b is branched and returned to three portions of the plating vessel). The plating bath b discharged from the bottom of the second vessel 212 is transferred to the oxidative decomposition vessel 3 by means of a pump P3*a* or to the copper dissolution vessel 4 by means of a pump P4*a*.

On the other hand, the overflow vessels 22, 23 are each constituted of one vessel, and the plating baths b discharged from the bottoms thereof are, respectively, returned to the plating vessel through the respective filters F by means of pumps P22, P23 (in this instance, the bath b is branched and returned to three portions of the plating vessel as shown in FIG. 4). It will be noted that the three overflow vessels 21, 22, 23 communicate with one another through a communication pipe 20 (with the overflow vessel 21, the communication pipe 20 is connected to the first vessel 211), thereby permitting the plating baths b to be mutually movable).

The oxidative decomposition vessel 3 is constituted of two line oxidative decomposition vessels 31, 32 arranged parallel to each other. In the oxidative decomposition vessels 31, 32, metallic copper m accommodated in meshwork baskets 311, 321, which are, respectively, formed of a material insoluble in the plating bath, are placed as being immersed in the plating bath b when the plating bath b is charged. Air nozzles 312, 322 for subjecting the metallic copper m to air bubbling are provided at the bottom of the oxidative decomposition vessels 31, 32 and located below the metallic copper m (i.e. the baskets 311, 321).

With the case of this instance, the transfer line of the plating bath from the second vessel 212 of the overflow vessel 21 to the oxidative decomposition vessel 3 is branched. The transferred plating bath b is appropriately introduced into the oxidative decomposition vessels 31, 32 by switching, opening and closing of a valve V31*a* provided in a flow path of introducing the plating bath into the oxidative decomposition vessel 31 and a valve V32*a* provided in a flow path of introducing the plating bath into the oxidative decomposition vessel 32. On the other hand, the transfer lines of the plating bath b discharged from the oxidative decomposition vessels 31, 32 are combined in the middle thereof, and the plating bath b is transferred from the oxidative decomposition vessel 3 through the filter F to the first vessel 211 of the overflow vessel 21 by means of a pump P3*b*. This plating bath is appropriately discharged by switching, opening and closing of a valve V31*b* provided in a flow path of discharging the plating bath from the oxidative decomposition vessel 31 and a valve V32*b* provided in a flow path of discharging the plating bath from the oxidative decomposition vessel 32.

The copper dissolution vessel 4 is so arranged that the plating bath b is introduced from the second vessel 212 of the overflow vessel 21 and the plating bath discharged from the bottom of the copper dissolution vessel 4 is transferred to the first vessel 211 of the overflow vessel 21 through the filter F by means of a pump P4*b*. Copper oxide power p is appropriately charged from a reservoir 40 for the copper oxide powder p into the copper dissolution vessel 4 by opening or closing of a valve V4*a*, if necessary. In this instance, in order to efficiently dissolve the charged copper oxide powder p, an agitator and agitation blades 41 for mechanical agitation and an air nozzle 42 for agitation by air bubbling are provided.

In the plating vessel 1, there is provided an online analysis supply device 5 for analyzing plating components in the plating bath b accommodated in the plating vessel 1, particularly, concentrations of components other than copper ions such as organic additives and the like, by a method such as of CVS (Cyclic Voltammetry Stripping) or the like and also for appropriately replenishing plating components correspondingly to the results of the analyses. Depending on the change in concentration of the plating components calculated from signals detected by means of an electrode 51 immersed in the plating bath b in the plating vessel 1, a replenishing solution of plating components is supplied to the first vessel 211 of the overflow vessel 21.

It will be noted that in the figures, symbols L21, L31, L32 and L4, respectively, indicate solution level sensors for detecting solution levels of the plating baths b in the overflow vessel 21, oxidative decomposition vessel 31, oxidative decomposition vessel 32 and copper dissolution vessel 4. Reference numeral 6 indicates a control unit controlling the operations of individual devices of the plating apparatus. Communication wires connect the control unit 6 with each device are omitted in the figures. In response to the solution level signals from the solution level sensors L21, L31, L32 and L4 and also to signals from an integrating current flow meter provided at the rectifier 12, the control unit 6 acts to control the opening and closing of the valves V31*a*, V32*a*, V31*b*, V32*b* and V4*a*, the start and stop of the pumps P3*a*, P3*b*, P4*a* and P4*b*, the commencement and stop of air bubbling of the air nozzles 312, 322 and 42, the start and stop of the agitator 41, and the commencement and stop of the feed of the copper oxide powder p from the reservoir 40.

Next, an instance of a continuous copper electroplating method of the invention using the above-stated plating apparatus is described.

(1) Copper Electroplating

At the preparation of an initial plating bath, given amounts of a plating bath b are accommodated in the oxidative decomposition vessel 31 (the one-line oxidative decomposition vessel) and the copper dissolution vessel 4 selected among the plating vessel 1, the overflow vessels 21, 22, 23 and the oxidative decomposition vessel 3. The pumps P21, P22, P23 are started to start the return of the plating bath b from the overflow vessels 21 (first vessel 211), 22, 23 to the plating vessel 1, followed by circulating the plating bath b by permitting the plating bath b to overflow from the plating vessel 1 to the respective overflow vessels 21, 22, 23. It will be noted that the pump P21 is constantly operated. The pump P1 is started to cause a jet of the plating bath b from the jet nozzle 13 along with the air agitator 14 being operated. Moreover, the pump P4*b* is started to commence the return of the plating bath b from the copper dissolution vessel 4 to the first vessel 211 of the overflow vessel 21. In response to signals from the solution level sensor L21 of the overflow vessel 21 and the solution level sensor L4 of the copper dissolution vessel 4, the start of the pump P4*a* is stopped and the opening and closing of the valve V4*a* is controlled, under which while keeping the solution levels of the overflow vessel 21 and the copper dissolution vessel 4 within given ranges, the plating bath b is circulated. In this state, the workpiece w to be plated is immersed in the plating bath b of the plating vessel 1, and an electric current is passed between the insoluble anodes 11, 11 and the workpiece w to subject the workpiece w to copper electroplating. In this way, while appropriately replacing the workpiece w by a fresh one, the plating is continuously carried out.

(2) Oxidative Decomposition of Decomposed/Degenerated Organic Products

As the plating proceeds, the organic additives contained in the copper electroplating bath are decomposed or undergo degeneration to increase the amounts of decomposed/degenerated organic products (decomposed organic products and/or degenerated organic products) that adversely influence the characteristics of plating film. To avoid this, the plating bath subjected to the plating is timely subjected to oxidative decomposition treatment. In this case, the oxidative decomposition vessel 32 (i.e. the other line oxidative decomposition vessel) becomes empty (see FIG. 1), and the plating bath b is introduced from the second vessel 212 of the overflow vessel 21 into the oxidative decomposition vessel 32 (see FIG. 2). To this end, the valve V31*a* is closed and the valve V32*a* is opened, and the start and stop of the pump P3*a* is controlled in response to the signals from the solution level sensor L21 of the overflow vessel 21 and the solution level sensor L32 of the oxidative decomposition vessel 32. In this condition, while keeping the solution level of the overflow vessel 21 within a given range, the plating bath b is introduced until the bath in the oxidative decomposition vessel 32 is at a given level (or is filled) (see FIG. 3).

On the other hand, this oxidative decomposition vessel 31 is accommodated therein with a plating bath b (provided that at the stage immediately after preparation, this bath is a plating bath obtained at the time of the preparation) which has been subjected to oxidative decomposition treatment in an immediately preceding oxidative decomposition treatment cycle (see FIG. 1). Simultaneously with the introduction of the plating bath b into the oxidative decomposition vessel 32, the plating bath b accommodated in the oxidative decomposition vessel 31 is transferred from the oxidative decomposition vessel 31 to the first vessel 211 of the overflow vessel 21 (see FIG. 2). For this purpose, the pump P3*b* is constantly operated thereby causing the plating bath to be transferred until the bath of the oxidative decomposition vessel 31 arrives at a given level (or the vessel 31 becomes empty) (see FIG. 3).

Next, the oxidative decomposition vessel 32 charged with the plating bath b is immersed therein with the metallic copper m. Air bubbling against the metallic copper m starts from the air nozzle 322 to subject the plating bath b to oxidative decomposition treatment. In this oxidative decomposition treatment, while the metallic copper m is dissolved as copper ions, decomposed/degenerated organic products can be oxidatively decomposed on the surface of the metallic copper m by the action non-electrolytic oxidation action independent from an electric current applied between the anode (insoluble anode 11) and the cathode (workpiece w to be plated). After the oxidative decomposition treatment over a given time (a necessary time may be set, for example, by confirming a treating time and an extent of oxidative decomposition of decomposed/degenerated organic products beforehand by a pre-test), the air bubbling from the air nozzle 322 is stopped to stop the oxidative decomposition treatment. It will be noted that bubbling against the metallic copper is feasible by application of any of known techniques.

The above procedure can be alternately repeated with respect to the two oxidative decomposition vessels 31, 32 of the oxidative decomposition vessel 3. In this way, the plating bath b is circulated while being subjected to oxidative decomposition treatment. It will be noted that the oxidative decomposition vessel 31 becoming empty corresponds to the other line oxidative decomposition vessel in a next oxidative decomposition treatment cycle. In this case, the valve 31*a* is opened and the valve V32*a* is closed, the start and stop of the pump P3*a* is controlled in response to signals from the solution level sensor L21 of the overflow vessel 21 and the solution level sensor L31 of the oxidative decomposition vessel 31. In this condition, while keeping the solution level of the overflow vessel 21 within a given range, the plating bath b is introduced from the second vessel 212 of the overflow vessel 21 into the oxidative decomposition vessel 31 until the solution level of the oxidative decomposition vessel 31 arrives at a given level (or the oxidative decomposition vessel 31 is filled up).

On the other hand, the oxidative decomposition vessel 32 accommodating the plating bath b after the oxidative decomposition treatment corresponds to the one-line oxidative decomposition vessel in the next oxidative decomposition treatment cycle. In this case, the valve V31*b* is closed and the valve V32*b* is opened. The pump P3*b* is constantly operated and the plating bath b accommodated in the oxidative decomposition vessel 32 is transferred from the oxidative decomposition vessel 32 to the first vessel 211 of the overflow vessel 21 until the bath in the oxidative decomposition vessel 31 arrives at a given level (or becomes empty).

The metallic copper m exposed to air bubbling from the air nozzle 312 in the oxidative decomposition vessel 31 charged with the plating bath b permits the plating bath b to be subjected to oxidative decomposition treatment. In a manner as stated above, when the oxidative decomposition is alternately repeated using the two oxidative decomposition vessels 31, 32, the oxidative decomposition treatment of the plating bath b can be repeatedly carried out while keeping the solution level of the plating bath b in the plating vessel 1 and continuing the copper electroplating of the workpiece w to be plated in the plating vessel 1.

It is to be noted that in the course of transferring the plating bath b from the oxidative decomposition vessel 3 to the overflow vessel 21 (first vessel 211), when the flow rate in the pump P3*b* is controlled, the plating bath b can be transferred in such a way that a discharge amount of the plating bath from the second vessel 212 of the overflow vessel 21 upon introduction of the plating bath b into the oxidative decomposition vessel 3 can be invariably made greater than a charge amount of the plating bath b from the oxidative decomposition vessel 3 upon return of the plating bath b to the first vessel 211 of the overflow vessel 21.

In this instance, two oxidative decomposition vessels are provided, which is not limitative. If the above procedure is possible using two-line oxidative decomposition vessels, the oxidation decomposition treatment may be alternately performed using three or more oxidative decomposition vessels, or a plurality of oxidative decomposition vessels in one-line may be provided for the oxidative decomposition treatment. In this case, the capacities of individual oxidative decomposition vessels are preferably equal to one another. Alternatively, one oxidative decomposition vessel may be used, in which, for example, an intermediate vessel is provided in the middle of a return path of the plating bath b from the oxidative decomposition vessel to the first vessel 211 of the overflow vessel 21. The plating bath b after the oxidative decomposition treatment is once transferred from the oxidative decomposition vessel to the intermediate vessel thereby causing the oxidative decomposition vessel to be empty. In a next oxidative decomposition cycle, the plating bath b is introduced from the second vessel 212 of the overflow vessel 21 into the oxidative decomposition vessel and at the same time, the plating bath b is transferred from the intermediate vessel to the first vessel 211 of the overflow vessel 21.

Furthermore, an instance where the overflow vessel 21 is constituted of the first vessel (first overflow vessel) 211 and the second vessel (second overflow vessel) 212 and the plating bath b discharged from the second vessel 212 is introduced into the oxidative decomposition vessel 3 has been set out hereinabove. Alternatively, for example, it is possible to provide a solution level sensor in the plating bath b in the plating vessel 1 so as to control the solution level of the plating bath b in the plating vessel 1, thereby directly introducing the plating bath b from the plating vessel 1 into the oxidative decomposition vessel 3. In doing so, the overflow vessel 21 may be formed of one vessel without resorting to a two-vessel arrangement including the first vessel 211 and the second vessel 212. In this connection, however, such a two-vessel arrangement of the overflow vessel as set out hereinabove is advantageous in that the solution level in the plating vessel 1 can be more stabilized.

Further, an instance where the plating bath b is returned from the oxidative decomposition vessel 3 to the first vessel 211 of the overflow vessel 21 has been set out. Alternatively, the plating bath b returned from the oxidative decomposition vessel 3 may be returned to other overflow vessels (overflow vessels 22, 23) having a function similar to the first vessel 211 of the overflow vessel 21.

Cycle intervals of the oxidative decomposition treatment may be either continuous (i.e. immediately after completion of the oxidative decomposition treatment, a next cycle begins), or in a batchwise or intermittent manner (i.e. a next cycle begins at some interval after completion of the oxidative decomposition treatment). The cycle intervals of the oxidative decomposition treatment may be taken in every given plating amount (deposition amount)(e.g. in every given amount determined by measurement with an integrated current amount for plating).

(3) Replenishment of Copper Ions

As plating proceeds, the amount of copper ions present in the copper electroplating bath decreases, and copper ions may be appropriately replenished in the plating bath used for the plating. If a dissolution operation of copper oxide powder p as will be described later is not carried out, the plating bath b is introduced from the second vessel 212 of the overflow vessel 21 as stated hereinabove. The plating bath b discharged from the bottom of the copper dissolution vessel 4 is transferred to the first vessel 211 of the overflow vessel 21 through the filter F by means of the pump P4*b* and is thus circulated. Initially, the pump P4*b* is stopped and the return of the plating bath b from the copper dissolution vessel 4 to the first vessel 211 of the overflow vessel 21 is stopped. The start and stop of the pump P4*a* and the opening and closing of the valve V4*a* are, respectively, controlled in response to signals from the solution level sensor L21 of the overflow vessel 21 and the solution level sensor L4 of the copper dissolution vessel 4. When the solution levels of the overflow vessel 21 and the copper dissolution vessel 4 arrive at given ranges, respectively, the pump P4*a* is completely stopped and the valve V4*a* is closed.

Next, a given amount of the copper oxide powder (CuO powder in general) is charged from the reservoir 40 and is dissolved in the plating bath b under mechanical agitation with an agitator and agitation blades 4 and also by air bubbling with the air nozzle 42. When the copper oxide powder p is dissolved after lapse of a given time, the mechanical agitation and air bubbling are stopped to complete the dissolution operation of the copper oxide powder p.

Thereafter, the pump P4*b* is again started and the return of the plating bath b from the copper dissolution vessel 4 to the first vessel 211 of the overflow vessel 21 is re-started. The pump P4*a* is left in a standby mode, and the start and stop of the pump P4*a* and the opening and closing of the valve V4*a* are controlled in response to signals from the solution level sensor L21 of the overflow vessel 21 and the solution level sensor L4 of the copper dissolution vessel 4. While keeping the solution levels of the overflow vessel 21 and the copper dissolution vessel 4 within given ranges, respectively, the plating bath b is circulated.

In this way, while keeping the solution level of the plating bath b in the plating vessel 1 and continuing copper electroplating of the workpiece w to be plated in the plating vessel 1, the copper ions can be supplied to the plating bath b.

It will be noted that an instance where the overflow vessel 21 is constituted of the first vessel (first overflow vessel) 211 and the second vessel (second overflow vessel) 212, and the plating bath b discharged from the second vessel 212 is introduced into the copper dissolution vessel 4 has been illustrated. Alternatively, for example, it may be possible that a solution level sensor is provided in the plating bath b of the plating vessel 1 to control the solution level of the plating bath in the plating vessel 1, and the plating bath b is introduced from the plating vessel 1 directly into the copper dissolution vessel 4. This enables the overflow vessel 21 to be constituted of one vessel without use of a two-vessel arrangement including the first vessel 211 and the second vessel 212. In this connection, however, such a two-vessel arrangement of the overflow vessel as stated above is advantageous in that the solution level of the plating vessel 1 can be more stabilized.

An instance where the plating bath b is returned from the copper dissolution vessel 4 to the first vessel 211 of the overflow vessel 21 has been illustrated in this example. Alternatively, it may be possible that the plating bath b returned to the copper dissolution vessel 4 is returned to other overflow vessels (overflow vessels 22, 23) having a function similar to the first vessel 211 of the overflow vessel 21. Moreover, the plating bath b from the oxidative decomposition vessel 3 and the plating bath b from the copper dissolution vessel 4 may be returned to different overflow vessels, respectively.

Since the plating amount (deposition amount) is substantially equal to an integrated electric current amount, intervals of the replenishment of copper ions are determined as corresponding to a given plating amount (i.e. a given deposition amount) (e.g. a given amount determined after measurement of an integrated electric current amount for plating). More frequent intervals of the replenishment of copper ions leads to a smaller variation in concentration of copper ions in the plating bath, with concern that the number of replenishments of copper ions becomes great, so that a dissolution operation time of copper oxide in the copper dissolution vessel cannot be secured satisfactorily. In contrast, if the intervals of replenishment of copper ions are prolonged, it becomes necessary to dissolve a large amount of copper oxide in the copper dissolution vessel in one dissolution operation. It takes a long time before dissolution. In addition, a difference between the copper ion concentration in the plating bath returned to the plating vessel and the copper ion concentration in the plating bath in the plating vessel becomes great. When the former plating bath is returned to the plating vessel, an abrupt variation takes place in the copper ion concentration, with concern that plating characteristics are adversely influenced. It is preferred that the intervals of replenishment of copper ion are at 0.5 to 4 hours while taking the reduction in amount of copper ions in the plating bath into account.

(4) Replenishment of Components other than Copper Ions

As plating proceeds, components other than copper ions contained in the copper electroplating bath are reduced in amount, for example, by such degeneration or decomposition of organic additives as set out hereinabove and by entrainment of the plating bath attached to a workpiece to be plated. It is preferred to appropriately replenish components other than copper ions to the plating bath having subjected to plating. In this instance, the concentrations of the components in the plating bath b accommodated in the plating vessel 1, particularly the components other than copper ions such as organic additives, are analyzed by means an on-line analyzing supply device 5 according to a method such as CVS or the like, and the plating components can be replenished in response to the results of the analysis. A replenishing solution of lo plating components can be supplied to the first vessel 211 of the overflow vessel 21 in response to a change in concentration of the plating components calculated from a signal detected by means of the electrode 51 immersed in the plating bath b of the plating vessel 1. It will be noted is that if necessary, water may be supplied as it is or in the form of an aqueous solution of plating components. Components other than copper ions may be appropriately replenished by analyzing the concentrations of the plating components by a known technique, if necessary, without resorting to the on-line analyzing supply device 5.

In this example, an instance where the replenishing solution is supplied from the on-line analyzing supply device 5 to the first vessel 211 of the overflow vessel 21 has been set out hereinabove. It may be possible to feed the replenishing solution to other overflow vessels (overflow vessels 22, 23) having a function similar to the first vessel 211 of the overflow vessel 21. Moreover, the plating bath b from the oxidative decomposition vessel 3 and the plating bath b from the copper dissolution vessel 4 may be returned to different overflow vessels, respectively.

The above-indicated steps of (2) the oxidative decomposition of decomposed/degenerated organic products, (3) the replenishment of copper ions and (4) the replenishment of components other than copper ions may be independently made while continuously carrying out copper electroplating.

It will be noted that if the flow rate of the pump P21 is controlled, it is possible that a discharge amount per unit time of the plating bath b from the first vessel (first overflow vessel) 211 of the overflow vessel 21 invariably increases over a discharge amount per unit time of the plating bath b from the second vessel (second overflow vessel) 212 of the overflow vessel 21.

In the practice of the invention, the copper sulfate plating bath contains organic additives. The organic additives are those which are added to a copper sulfate electroplating bath and are called brightener, leveler, promoter, controlling agent and the like. For this, there are mentioned nitrogen-containing organic compounds, sulfur-containing organic compounds, oxygen-containing organic compounds and the like, which are conventionally known and added to copper sulfate electroplating baths.

The organic additives and the concentrations thereof in a copper sulfate plating bath used in the invention are shown below.

The organic additives used are known ones. For instance, it is preferred that if a sulfur-containing organic matter is used, one or more of those indicated by the following formulas (1) to (3) are contained in an amount of 0.01 to 100 mg/liter, more preferably 0.1 to 50 mg/liter.

$$R_1—S—(CH_2)_n—(O)_p—SO_3M \quad (1)$$

$$(R_2)_2N—CSS—(CH_2)_n—(CHOH)_p—(CH_2)_n—(O)_p—SO_3M \quad (2)$$

$$(R_2)—O—CSS—(CH_2)_n—(CHOH)_p—(CH_2)_n—(O)_p—SO_3M \quad (3)$$

wherein $R_1$ represents a hydrogen atom or a group represented by $—(S)_m—(CH_2)_n—(O)_p—SO_3M$, $R_2$s independently represent an alkyl group having 1 to 5 carbon atoms, M represents a hydrogen atom or an alkali metal, m is 0 or 1, n is an integer of 1 to 8, and p=0 or 1.

As a polyether compound, mention is made of compounds containing a polyalkylene glycol having not less than four —O— linkages. More particularly, mention is made of polyethylene glycol, polypropylene glycol and copolymers thereof, polyethylene glycol fatty acid esters, polyethylene glycol alkyl ethers and the like. These polyether compounds are preferably contained in an amount of 10 to 5000 mg/liter, more preferably 100 to 1000 mg/liter.

Further, the nitrogen-containing compounds include polyethyleneimines and derivatives thereof, polyvinylimidazole and derivatives thereof, polyvinylakylimidazoles and derivatives thereof, copolymers of vinylpyrrolidone, vinylalkylimidazoles and derivatives thereof, and dyes such as janus green and are preferably contained in an amount of 0.001 to 500 mg/liter, more preferably 0.01 to 100 mg/liter.

On the other hand, there is preferably used, for example, as a copper sulfate plating bath containing 10 to 65 g/liter of copper ions ($Cu^{2+}$) and 20 to 250 g/liter of sulfuric acid. The copper sulfate plating bath preferably includes 20 to 100 mg/liter of chloride ions ($Cl^-$). It should be noted that the pH of the copper sulfate plating bath is generally at 2 or below.

In the invention, copper electroplating is carried out on a workpiece to be placed using a soluble anode or insoluble anode as an anode and the workpiece as a cathode. A cathode current density generally ranges 0.5 to 7 A/dm$^2$, preferably 1 to 5 A/dm$^2$. The plating temperature generally ranges from 20 to 30° C.

The invention is particularly suited for copper electroplating for forming a wiring pattern on printed circuit boards (including plastic package substrates, semiconductor substrates and the like), wafers and the like as a workpiece to be plated.

Japanese Patent Application No. 2007-195827 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A continuous copper electroplating method wherein a workpiece to be placed is continuously electroplated in a plating vessel accommodating a copper sulfate plating bath containing an organic additive by use of a soluble or insoluble anode as an anode and the workpiece as a cathode, the method comprising the steps of:

providing an overflow vessel for accommodating a plating bath overflowing from said plating vessel adjacent to said plating vessel, returning the plating bath in said overflow vessel to said plating vessel while permitting the plating bath from said plating vessel to overflow into said overflow vessel, providing an oxidative decomposition vessel different from said plating vessel, transferring the plating bath to said oxidative decomposition vessel, and returning the plating bath from said oxidative decomposition vessel through said overflow vessel to said plating vessel for circulating the plating bath between said plating vessel and said oxidative decomposition vessel; and metallic copper is immersed in said oxidative decomposition vessel and exposed to air bubbling, so that while said metallic copper is dissolved in the form of copper ions in said oxidative decomposition vessel;

decomposed organic products and/or degenerated organic products formed by decomposition or degeneration of said organic additive in the course of the copper electroplating are subjected to oxidative decomposition treatment on surfaces of said metallic copper by non-electrolytic oxidation action independent from a current applied between said anode and said cathode, wherein said overflow vessel comprises first and second overflow vessels through which the plating baths are mutually movable, under which the plating bath is returned from the first overflow vessel to said plating vessel and the plating bath is introduced from said second overflow vessel into said oxidative decomposition vessel to subject the plating bath to oxidative decomposition treatment, and the plating bath after the oxidative decomposition treatment is introduced from said oxidative decomposition vessel into the first overflow vessel for circulating the plating bath between said plating vessel and said oxidative decomposition vessel.

2. The continuous copper electroplating method according to claim 1, wherein a copper dissolution vessel different from said plating vessel and said oxidative decomposition vessel is provided, the plating bath is transferred from said second overflow vessel into said copper dissolution vessel and the plating bath in said copper dissolution vessel is transferred to said first overflow vessel to circulating the plating bath between said plating vessel and said copper dissolution vessel, and copper oxide is charged into said copper dissolution vessel for dissolution for replenishing copper ions consumed by the plating in the plating bath.

3. The continuous copper electroplating method according to claim 1, wherein a replenishing solution of components other than copper, which are consumed in the plating bath by the plating, is introduced into said first overflow vessel to replenish the components other than the copper.

4. The continuous copper electroplating method according to claim 1, wherein a discharge amount per unit time of the plating bath from said first overflow vessel is made invariably greater than a discharge amount per unit time of the plating bath from said second overflow vessel.

* * * * *